US009255358B2

(12) United States Patent
Kim

(10) Patent No.: US 9,255,358 B2
(45) Date of Patent: Feb. 9, 2016

(54) DRYING DEVICE AND METHOD FOR DRYING LAUNDRY

(71) Applicant: Dongbu Daewoo Electronics Corporation, Seoul (KR)

(72) Inventor: In Dong Kim, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 147 days.

(21) Appl. No.: 14/080,731

(22) Filed: Nov. 14, 2013

(65) Prior Publication Data

US 2014/0182161 A1 Jul. 3, 2014

(30) Foreign Application Priority Data

Dec. 27, 2012 (KR) ..... 10-2012-0154991

(51) Int. Cl.

| | |
|---|---|
| ***D06F 58/00*** | (2006.01) |
| ***D06F 58/20*** | (2006.01) |
| ***D06F 58/24*** | (2006.01) |
| ***D06F 25/00*** | (2006.01) |

(52) U.S. Cl.

CPC ..... *D06F 58/20* (2013.01); *D06F 25/00* (2013.01); *D06F 58/24* (2013.01)

(58) Field of Classification Search

CPC ..... F26B 19/00; F26B 21/00; F26B 21/06; F26B 25/00; D06F 58/00; D06F 58/20; Y10T 137/05978; Y10T 137/0318

USPC ..... 34/595, 282, 381, 132, 88; 68/5 C, 5 R, 68/18 C, 19.2; 8/137, 149, 159; 137/1, 137/565.01

See application file for complete search history.

(56) References Cited

U.S. PATENT DOCUMENTS

| | | | | |
|---|---|---|---|---|
| 2,833,056 | A * | 5/1958 | Smith | 34/527 |
| 2,985,966 | A * | 5/1961 | Martin | 34/75 |
| 6,954,995 | B2 * | 10/2005 | Kitamura et al. | 34/597 |
| 7,325,330 | B2 * | 2/2008 | Kim et al. | 34/407 |
| 7,526,879 | B2 * | 5/2009 | Bae et al. | 34/596 |
| 7,997,006 | B2 * | 8/2011 | Son et al. | 34/381 |
| 8,112,904 | B2 * | 2/2012 | Kono et al. | 34/595 |
| 8,136,264 | B2 * | 3/2012 | Bae et al. | 34/381 |
| 8,881,556 | B2 * | 11/2014 | Kawabata et al. | 68/208 |
| 8,997,377 | B2 * | 4/2015 | Kim et al. | 34/610 |
| 9,009,987 | B2 * | 4/2015 | Lee et al. | 34/443 |
| 2001/0015082 | A1 * | 8/2001 | Minayoshi et al. | 68/19.2 |
| 2003/0056393 | A1 * | 3/2003 | Lee et al. | 34/595 |
| 2009/0077755 | A1 * | 3/2009 | Park et al. | 8/137 |
| 2009/0260404 | A1 * | 10/2009 | Saito et al. | 68/20 |
| 2013/0239336 | A1 * | 9/2013 | Kim et al. | 8/137 |
| 2014/0182161 | A1 * | 7/2014 | Kim | 34/282 |
| 2014/0182685 | A1 * | 7/2014 | Kim | 137/1 |

FOREIGN PATENT DOCUMENTS

| | | | |
|---|---|---|---|
| DE | 102011087258 | * | 5/2013 |
| EP | 2280115 | A1 * | 2/2011 |

(Continued)

*Primary Examiner* — Steve M Gravini

(57) ABSTRACT

A drying device for a washing machine includes a rotatable drum configured to house laundry items; a tub having the drum therein; a driving unit on the tub and connected to the drum, configured to drive the drum; a drying unit configured to store liquid water and circulate air in the drum to remove moisture from the laundry; and a control unit configured to control operations of the drying unit.

14 Claims, 4 Drawing Sheets

(56) References Cited

FOREIGN PATENT DOCUMENTS

| | | | |
|---|---|---|---|
| EP | 2749683 A1 * | 7/2014 | |
| KR | KO 10-1246380 | * | 3/2013 |
| WO | WO 2012034434 A1 | * | 3/2012 |

* cited by examiner

DRYING DEVICE AND METHOD FOR DRYING LAUNDRY

CROSS-REFERENCES TO RELATED APPLICATIONS

The present application claims priority to Korean application number 10-2012-0154991, filed on Dec. 27, 2012, which is incorporated herein by reference in its entirety.

BACKGROUND OF THE INVENTION

The present invention relates to a drying device and method for a washing machine, and more particularly, to a drying device and method for a combined washing and drying machine that is capable of improving drying efficiency while suppressing the use of condensate water (e.g., liquid water) during a drying cycle.

In general, a drum washing machine includes a door at the front of the washing machine, through which laundry items are put into the washing machine. The drum washing machine may use a relatively small amount of wash water and detergent because laundry items are rubbed and washed while falling downward in the drum washing machine.

Furthermore, the drum washing machine includes a tub and a drum. The tub is in a case or cabinet forming the exterior of the drum washing machine and stores wash water therein, and the drum is in the tub and has one open side through which laundry items are put in the washing machine.

The tub is supported by one or more dampers to suppress vibrations, and the drum is rotated by a motor to mix the laundry items.

The drum has a cylindrical shape of which one side is open, and includes a plurality of holes therein to discharge wash water. Furthermore, the drum includes a plurality of lifters therein.

Thus, when the drum is rotated, laundry items are moved upward by the lifters, and then fall downward into the wash water and detergent. Thus, the laundry items may be rubbed and washed.

The drum washing machine may include a heater therein. As the heater supplies high-temperature air into the drum, the washed laundry items may be dried.

The related art of the present invention has been disclosed in Korean Patent Laid-open Publication No. 2004-0087522 published on Oct. 14, 2004 and titled "Drying device for drum washing machine and method for controlling the same".

In accordance with the conventional drum washing machine, condensate water (or liquid water) is continuously supplied (e.g., to the tub) while the drying process is performed. Thus, there are difficulties in reducing the amount of condensate water (or liquid water) to be used during drying.

Therefore, there is a demand for a structure capable of solving such problem(s).

SUMMARY OF THE INVENTION

Embodiments of the present invention are directed to a drying device and method for a washing machine that is capable of improving drying efficiency while suppressing the use of condensate water.

In one or more embodiments, a drying device for a washing machine includes a rotatable drum configured to hold laundry items therein; a tub having the drum therein; a driving unit on the tub, connected to the drum and configured to drive the drum; a drying unit configured to store liquid water and circulate air in the drum to remove moisture from the laundry; and a control unit configured to control operations of the drying unit.

The drying unit may include a storage duct under the tub, configured to communicate with the tub and store the condensate water; a circulation duct connected to the storage duct and configured to supply air to the drum; an air blower on the circulation duct configured to forcibly move the air; and a heater on the circulation duct configured to heat the air.

The storage duct may include a water level sensor configured to sense a water level of the liquid water (e.g., in the storage duct).

The storage duct may be connected to a drain unit for discharging the liquid water from the storage duct.

The drying unit may further include a supply part connected to the circulation duct configured to supply the liquid water.

In another embodiment, a method for drying laundry includes adjusting, by a control unit, a level of liquid water in a storage duct to a preset water level; and drying the laundry when the level of the liquid water reaches the preset water level. The laundry may be dried by the control unit performing a drying mode, and the method may be performed in a washing machine.

Adjusting the level of the liquid water may include discharging the liquid water through a drain unit when the level of the liquid water exceeds the preset water level.

Alternatively, adjusting the level of the liquid water may include supplying liquid water (e.g., through a supply part and/or to the storage duct) when the level of the liquid water is less than the preset water level.

The drying mode may be performed by maintaining the temperature of the air supplied to and/or in the drum at a preset temperature or within a preset temperature range for a preset time while rotating the drum (e.g., of the washing machine).

The drying method may further include discharging the liquid water in the storage duct when the drying mode is completed.

DETAILED DESCRIPTION

Embodiments of the invention will hereinafter be described in detail with reference to the accompanying drawings. It should be noted that the drawings are not necessarily to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
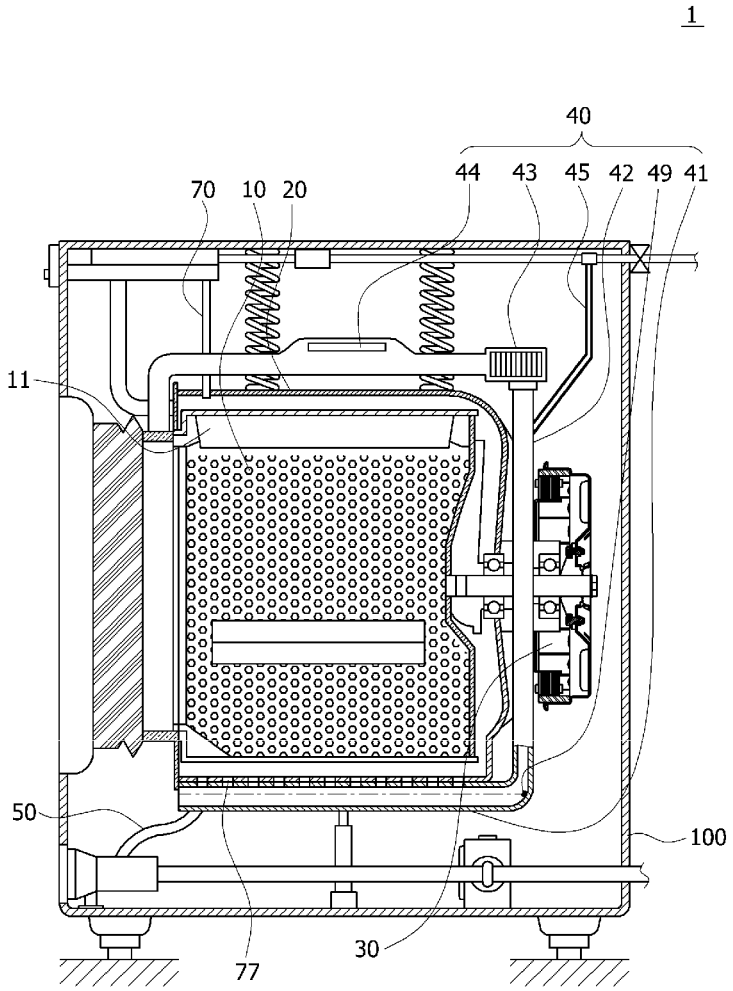
FIG. 1 schematically illustrates an exemplary drying device for a washing machine in accordance with one or more embodiments of the present invention.

FIG. 1 schematically illustrates a drying device for a washing machine in accordance with one or more embodiments of the present invention.

Referring to FIG. 1, the drying device 1 for a washing machine in accordance with embodiment(s) of the present invention includes a rotatable drum 10, a tub 20, a driving unit 30, and a drying unit 40.

The drum 10 forms a space in which laundry items are housed or stored (e.g., during one or more modes and/or operations of the washing machine). The drum 10 includes a plurality of lifters 11 therein. Thus, when the drum 10 is rotated, laundry items are moved upward by the lifters 11 and then fall downward.

The tub 20 is in a case or cabinet 100. The drum 10 is inside the tub 20.

The driving unit 30 is mounted on the tub 20 (e.g., a rear panel or wall of the tub) and connected to the drum 10 (e.g., a center location in the rear panel or wall of the drum). When the driving unit 30 is driven, the drum 10 rotates.

The drying unit 40 removes moisture while circulating air in the drum 10 (e.g., the internal air of the drum 10). One end of the drying unit 40 communicates with the tub 20, and another end of the drying unit 40 is connected to or communicates with the drum 10.

The drying unit 40 stores liquid water (condensate water). Thus, moisture in the air moving through the tub 20 is removed by the drying unit 40, and then the air is resupplied to the drum 10. The moisture removed from wet laundry in the drum 10 may condense in the drying unit 40 and be stored in the drying unit 40 until it is discharged.

The drying unit 40 in accordance with various embodiment(s) of the present invention includes a storage duct 41, a circulation duct 42, an air blower 43, and a heater 44.

The storage duct 41 is at the bottom of the tub 20. The storage duct 41 communicates with the tub 20, and forms a space in which liquid water (condensate water) may be stored.

For example, the storage duct 41 may be below or adjacent to the bottom or lowermost surface of the tub 20, and may communicate with the tub 20 through a plurality of through-holes 77. In another embodiment, the bottom or lowermost part of the tub 20 may protrude or extend downward to form a space for storing liquid water, and the space may serve as the storage duct 41.

One end of the circulation duct 42 is connected to the storage duct 41, and another end of the circulation duct 42 is in or near the drum 10. Thus, the air discharged from the tub 20 (e.g., into the storage duct 41) is resupplied to the drum 10 through the circulation duct 42.

The air blower 43 is mounted in the circulation duct 42. When the air blower 43 is driven, the air in the circulation duct 42 is forcibly moved and discharged to the drum 10.

The heater 44 is mounted in or over the circulation duct 42, and serves to heat the air moving through the circulation duct 42.

The storage duct 41 includes a water level sensor 49 mounted therein and/or thereon to sense the water level of the liquid water (e.g., in the storage duct 41). Furthermore, the storage duct 41 is connected to a drain unit 50. The drain unit 50 is configured to discharge wash water in the tub 20 or liquid water in the storage duct 41. The tub 20 is connected to a water supply unit 70 configured to supply wash water to the tub 20.

The drying unit 40 in accordance with various embodiment(s) of the present invention further includes a supply part 45. The supply part 45 is connected to the circulation duct 42 and is configured to supply liquid water to the storage duct 41.

The water supply unit 70, the drain unit 50, and the supply part 45 are operated by a control unit and are configured to supply or discharge wash water or liquid water, as the case may be. Furthermore, the control unit controls the driving unit 30, the air blower 43, and the heater 44. The water level sensor 49 transmits a sensing signal to the control unit.

Thus, wash water is supplied to the tub 20 by the water supply unit 70, and a washing mode is then performed by operating the driving unit 30. When the washing mode ends, a drying mode is performed by operating the air blower 43 and the heater 44.

During the drying mode, heated air enters the drum 10. The heated air removes water and/or moisture from wet laundry in the drum 10, and may contain moisture when it contacts laundry items in the drum 10. Then, the moisture in the air in the drum 10 from the laundry is removed while the air passes through the storage duct 41.

The air from which the moisture is removed passes through the circulation duct 42, is heated by the heater 44, and then enters the drum 10 again.

The liquid water in the storage duct 41 may include water remaining after a rinsing process (e.g., of the washing mode of the washing machine), water discharged from laundry items during a spin-drying process, or water supplied by or from the supply part 45.

Furthermore, foreign matter such as fuzz in the heated air supplied to the drum 10 may contact the liquid water in the storage duct 41 and then be removed while passing through the storage duct 41.

Figure 2:
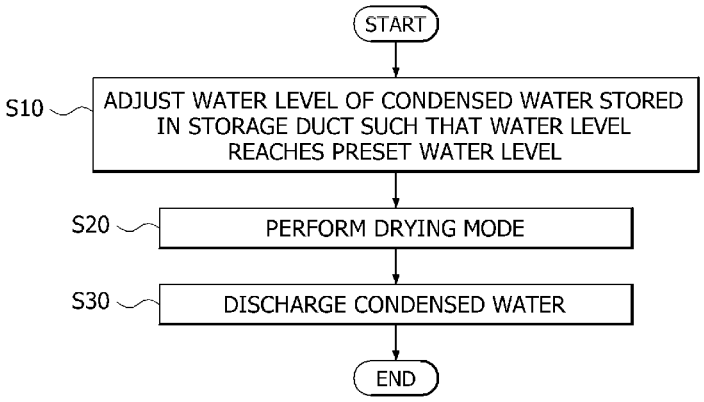
FIG. 2 is a flow chart schematically illustrating an exemplary drying method for a washing machine in accordance with one or more embodiments of the present invention.
Figure 3:
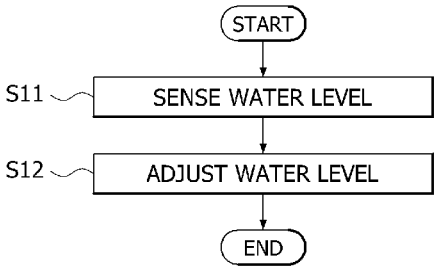
FIG. 3 is a flow chart schematically illustrating a method for adjusting a level of liquid water in a storage duct to a preset water level.
Figure 4:
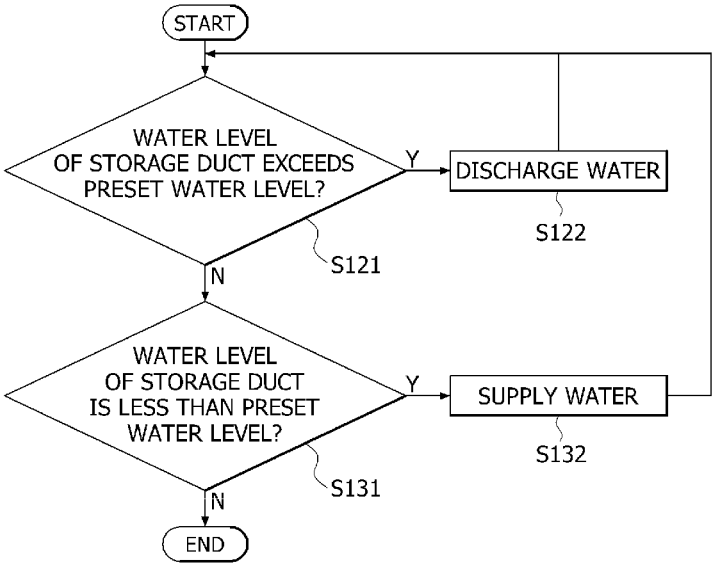
FIG. 4 is a flow chart schematically illustrating an exemplary method for adjusting the water level.
Figure 5:
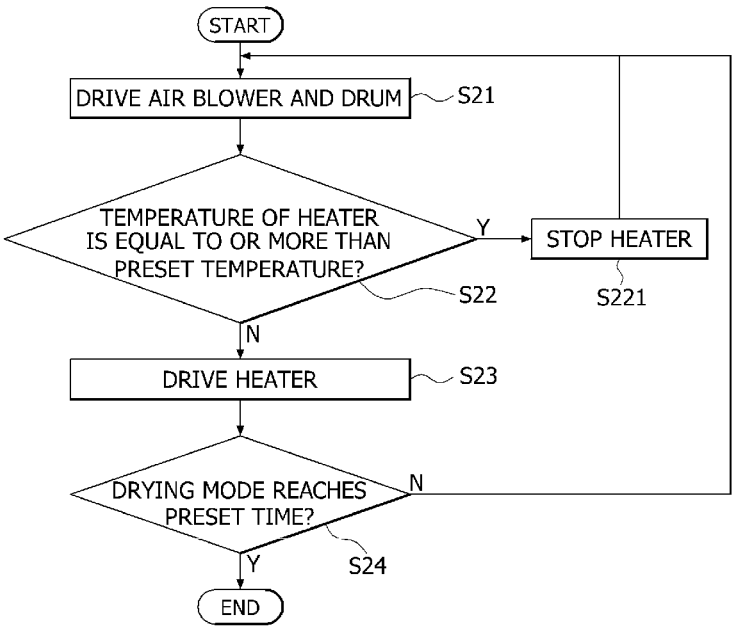
FIG. 5 is a flow chart schematically illustrating an exemplary drying mode.

FIG. 2 is a flow chart schematically illustrating a method of drying laundry that can be performed in a washing machine in accordance with one or more embodiments of the present invention. FIG. 3 is a flow chart schematically illustrating a method for adjusting the level of liquid water in a storage duct to a preset water level (e.g., step S10 in FIG. 2). FIG. 4 is a flow chart schematically illustrating a method for adjusting the water level (e.g., step S12 in FIG. 3). FIG. 5 is a flow chart schematically illustrating a drying mode (e.g., step S20 in FIG. 2).

Referring to FIG. 2, the method for drying laundry in a washing machine in accordance with various embodiment(s) of the present invention includes adjusting the level of liquid water in the storage duct 41 to a preset water level at step S10, and drying the laundry (e.g., performing a drying mode) when the level of the liquid water reaches the preset water level at step S20.

That is, when the level of the liquid water in the storage duct 41 reaches the preset water level, a drying mode is performed. At this time, moisture in the air in the drum is removed, and the moist air is pulled into the storage duct 41 where it comes in contact with the liquid water in the storage duct 41. Then, the air is heated and introduced into the drum 10 again.

The method for drying laundry in a washing machine in accordance with embodiment(s) of the present invention further includes discharging the liquid water from the storage duct 41 at step S30.

That is, when the drying mode is completed, the control unit operates the drain unit 50 to discharge the liquid water from the storage duct 41 to the outside.

When the liquid water in the storage duct 41 is removed, it is possible to prevent contamination caused by liquid water remaining in the storage duct 41.

Referring to FIG. 3, step S10, adjusting the level of the liquid water in the storage duct 41 in accordance with embodiment(s) of the present invention, includes sensing the level of the liquid water in the storage duct 41 at step S11 and adjusting the level of the liquid water according to a comparison of the level of the liquid water and the preset water level at step S12.

At step S11, the water level sensor 49 on and/or in the storage duct 41 senses the level of the liquid water stored in the storage duct 41.

The liquid water in the storage duct 141 after the washing mode may include water discharged from laundry items during a spin-drying process for the laundry items. The drain unit 50 may store a part of water in the storage duct 41 when the washing machine switches from the washing mode to the drying mode, thereby saving resources.

At step S12, the control unit compares the water level measured by the water level sensor 49 to the preset water level, and controls the drain unit 50 (e.g., to discharge or remove water from the storage duct 41) or the supply part 45 connected to the circulation duct 42 (e.g., to supply or add water to the storage duct 41).

The preset water level may correspond to a level between the uppermost portion and the middle portion of the storage duct 41. Alternatively, the preset water level can correspond to a height above a lowermost internal surface of the storage duct 41. In various embodiments, the preset water level corresponds to a percentage of the distance between the lowermost and uppermost internal surfaces of the storage duct 41. In one example, the preset water level corresponds to 75% of the distance from the lowermost internal surface to the uppermost internal surface of the storage duct 41. In other examples, the preset water level corresponds to 50%, 25%, 10% or any measurable distance from the lowermost internal surface to the uppermost internal surface of the storage duct 41.

Referring to FIG. 4, when the water level measured by the water level sensor 49 exceeds than the preset water level at step S121, the control unit controls the drain unit 50 to discharge liquid water from the storage duct 41 at step S122.

On the other hand, when the water level measured by the water sensor 49 is less than the preset water level at step S131, the control unit controls the supply part 45 to supply liquid water to the storage duct 41 at step S132.

As such, when the process of discharging or supplying liquid water is repeated, the level of the liquid water in the storage duct 41 reaches the preset water level.

Referring to FIG. 2, the control unit rotates the drum 10 and maintains the temperature of air supplied to the drum 10 at a preset temperature or within a preset temperature range for a preset time, in step S20 of performing the drying mode in accordance with embodiment(s) of the present invention. The preset temperature may be a temperature of from room temperature (e.g., "cool" or "air" drying), to 100° C. or more, depending on the type of laundry and/or the drying temperature selected by the user. Similarly, the preset temperature range may be a maximum temperature of, for example, 30° C. (e.g., "cool" or "air" drying), or a range of from 50° C. to 150° C., or any range of values therein, depending on the type of laundry and/or the drying temperature range selected by the user. However, to improve the efficiency of the water condensing process in the storage duct 41, a maximum temperature of 100° C. may be possible for the heated air in the circulation duct 42 to be used to dry the laundry in the drum 10.

Referring to FIG. 5, when the drying mode is performed, the control unit drives the air blower 43 and the drum 10, at step S21.

The control unit determines whether the temperature of the heater 44 is equal to or higher than the preset temperature when the air blower 43 and the drum 10 are driven at step S22.

That is, the heater 44 may include a temperature sensor to sense whether the heater 44 or the heated air is over a preset temperature for the heater or the air, respectively. The heater 44 may transmit a sensing signal to the control unit. The temperature sensor may measure the temperature of the heater 44 or measure the temperature of the air passing through the heater 44.

When the heater 44 is over the preset temperature, the control unit stops the heater 44 from heating to prevent damage to the heater 44 and/or laundry items at step S221.

Furthermore, when the temperature of the heater unit 44 or air in the circulation duct 42 is less than the preset temperature, the control unit drives the heater 44 at step S23.

After the heater 44 is driven, a timer counts the time to determine whether the drying mode has reached a preset time or not at step S24.

When the drying mode reaches the preset time, the drying mode ends. Alternatively, the user can manually end the drying mode (e.g., by turning off the drying mode or opening the door of the washing machine). When the drying mode does not reach the preset time, the procedure may return to the step S21 of driving the air blower 43 and the drum 10.

In accordance with embodiments of the present invention, as the storage duct stores condensate water (e.g., liquid water), it is possible to efficiently remove moisture of laundry items while suppressing the use of additional liquid water.

Furthermore, foreign matter such as fuzz from laundry items may come in contact with the liquid water in the storage duct and sink under or be removed from the recirculated air by the liquid water. Thus, while the laundry items are dried, foreign matter may be removed at the same time.

Furthermore, as wash water from the washing mode may be some or all of the liquid water in the storage duct, an otherwise wasted resource may be reused.

Embodiments of the present invention have been disclosed above for illustrative purposes. Those skilled in the art will appreciate that various modifications, additions and substitutions are possible, without departing from the scope and spirit of the invention as disclosed in the accompanying claims.

What is claimed is:

1. A drying device for a washing machine, comprising:

a rotatable drum configured to house laundry items therein;

a tub having the drum therein;

a driving unit on the tub, connected to the drum and configured to drive the drum;

a drying unit configured to store liquid water and circulate air in the drum to remove moisture from the laundry when a water level of liquid water reaches a preset water level; and a control unit configured to control operations of the drying unit and adjust a water level of liquid water such that the water level reaches the preset water level, wherein the drying unit comprises:

a storage duct under the tub, configured to communicate with the tub and store the liquid water;

a circulation duct connected to the storage duct and configured to supply air to the drum; an air blower on the circulation duct and configured to move the air;

a heater on the circulation duct and configured to heat the air; and a supply part connected to the circulation duct, configured to supply the liquid water to the storage duct, and wherein the drying unit stores water remaining after a rinsing process, water discharged from laundry items during a spin-drying process, or water supplied by the supply part, as the liquid water.

2. The drying device of claim 1, wherein the storage duct comprises a water level sensor configured to sense the water level of the liquid water.

3. The drying device of claim 2, wherein the control unit compares the water level sensed by the water level sensor to the preset water level.

4. The drying device of claim 3, wherein the control unit adjusts the water level of the liquid water in the storage duct until the water level is at the preset water level.

5. The drying device of claim 1, wherein the storage duct is connected to a drain unit for discharging the liquid water from the storage duct.

6. A method for drying laundry, comprising:

adjusting, by a control unit, a water level of liquid water stored in a storage duct such that the water level reaches a preset water level; and drying the laundry, by a drying unit, when the level of the liquid water reaches the preset water level, wherein the control unit controls operation of the drying unit, a rotatable drum configured to house laundry items therein, a tub having the drum therein, and a driving unit configured to drive the drum, and wherein the drying unit comprises: the storage duct under the tub, configured to communicate with the tub and store the liquid water;

a circulation duct connected to the storage duct and configured to supply air to the drum; an air blower on the circulation duct and configured to move the air; a heater on the circulation duct and configured to heat the air; and a supply part connected to the circulation duct, configured to supply the liquid water to the storage duct, and wherein the drying unit stores water remaining after a rinsing process, water discharged from laundry items during a spin-drying process, or water supplied by the supply part, as the liquid water.

7. The method of claim 6, wherein adjusting the water level of the liquid water comprises:

sensing, by a water level sensor, the water level of the liquid water in the storage duct; and comparing, by the control unit, the sensed water level to the preset water level.

8. The method of claim 7, wherein adjusting the water level of the liquid water further comprises adjusting the water level of the liquid water in the storage duct until the water level of the liquid water in the storage duct is at the preset water level.

9. The method of claim 8, wherein the water level of the liquid water is adjusted by:

discharging the liquid water through a drain unit when the sensed water level exceeds the preset water level; and supplying liquid water from the supply part when the sensed water level is less than the preset water level.

10. The method of claim 9, wherein the preset water level corresponds to a range between the uppermost portion and a middle portion of the storage duct.

11. The method of claim 6, wherein drying the laundry comprises maintaining a temperature of the air supplied to and/or in the drum at a preset temperature or within a preset temperature range for a preset time while rotating a drum housing the laundry.

12. The method of claim 6, further comprising discharging the liquid water from the storage duct after the laundry is dried.

13. The method of claim 6, wherein the method is performed in a washing machine.

14. The method of claim 13, wherein the laundry is dried by the control unit performing a drying mode in the washing machine.

* * * * *